US008191801B2

(12) United States Patent
Khan et al.

(10) Patent No.: US 8,191,801 B2
(45) **Date of Patent: *Jun. 5, 2012**

(54) AEROSOL SPRAY

(75) Inventors: Ayub Ibrahim Khan, Cincinnati, OH (US); Su-Yon McConville, Mason, OH (US); Christopher Luke Leonard, Mason, OH (US); Scott Edward Smith, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1343 days.

This patent is subject to a terminal disclaimer.

(21) Appl. No.: 11/092,081

(22) Filed: Mar. 29, 2005

(65) Prior Publication Data

US 2005/0224608 A1 Oct. 13, 2005

Related U.S. Application Data

(60) Provisional application No. 60/557,299, filed on Mar. 29, 2004.

(51) Int. Cl.

| | |
|---|---|
| ***A62C 2/08*** | (2006.01) |
| ***A62C 37/08*** | (2006.01) |
| ***B05B 1/14*** | (2006.01) |
| ***E21F 5/04*** | (2006.01) |
| ***F23D 11/38*** | (2006.01) |
| ***F23D 14/48*** | (2006.01) |
| *B05B 1/00* | (2006.01) |

(52) U.S. Cl. ..... 239/548; 239/600; 239/565

(58) Field of Classification Search ..... 239/5, 296, 239/337, 347, 372, 414, 543, 565, 527, 573, 239/579, 306, 106, 656; 222/145, 135, 148, 222/190, 330, 531

See application file for complete search history.

(56) References Cited

U.S. PATENT DOCUMENTS

| | | | | |
|---|---|---|---|---|
| 3,342,382 | A | 9/1967 | Huling | |
| 3,401,888 | A | 9/1968 | Sutter | |
| 3,406,913 | A * | 10/1968 | Frangos | 239/543 |
| 3,415,426 | A * | 12/1968 | Kleveland | 222/402.11 |
| 3,504,862 | A | 4/1970 | Lowry | |
| 3,628,733 | A * | 12/1971 | Kahn | 239/337 |
| 3,767,125 | A | 10/1973 | Gehres et al. | |
| 4,168,021 | A * | 9/1979 | Hardouin et al. | 222/394 |
| 4,239,407 | A | 12/1980 | Knight | |
| 5,249,747 | A * | 10/1993 | Hanson et al. | 239/373 |
| 5,516,045 | A | 5/1996 | Baudin | |
| 5,730,332 | A * | 3/1998 | Zimmerhackel | 222/148 |
| 5,813,785 | A | 9/1998 | Baudin et al. | |
| 5,890,661 | A * | 4/1999 | Crampton et al. | 239/544 |
| 6,158,674 | A * | 12/2000 | Humphreys | 239/333 |
| RE38,023 | E * | 3/2003 | De Laforcade | 239/337 |
| 6,817,493 | B1 * | 11/2004 | Parsons et al. | 222/402.1 |
| 2004/0195374 | A1 | 10/2004 | Parsons et al. | |

FOREIGN PATENT DOCUMENTS

| | | |
|---|---|---|
| DE | 1817056 | 7/1969 |
| DE | 2925435 A1 | 1/1981 |
| EP | 0077572 A | 4/1983 |
| EP | 0245822 A | 11/1987 |

* cited by examiner

*Primary Examiner* — Len Tran
*Assistant Examiner* — James Hogan
(74) *Attorney, Agent, or Firm* — Andrew J. Hagerty

(57) ABSTRACT

A spray head for attachment to an aerosol spray unit containing pressurized product is provided, the spray head having at least two separate spray outlets, wherein at least one of the spray outlets has a non-circular cross-section.

8 Claims, 2 Drawing Sheets

AEROSOL SPRAY

CROSS REFERENCE TO RELATED APPLICATIONS

This application claims the benefit of U.S. Provisional application Ser. No. 60/557,299 (Case CM2834FP), filed on Mar. 29, 2004.

FIELD

The present invention relates to an aerosol spray head, an aerosol spray unit comprising the aerosol spray head and a process for spraying pressurised product.

BACKGROUND

One conventional approach to dispensing a product onto a target application surface is via atomisation of that product. One way of achieving atomisation is to combine the product with a propellant (compressed gas) in a pressurized unit having a dispensing valve fluidly connected to a dispensing outlet. On opening the dispensing valve, the product is forced therethrough and dispensed via the outlet in an atomized form onto the target application surface.

The present inventors have established, however, that current atomization technology generally does not deliver a satisfactory product distribution onto the target area. In particular, the distribution is observed to be uneven, with increased deposition occurring in the centre and correspondingly reduced deposition towards the extremities of the target site. In addition to the uneven spread of active agent and resulting uneven achievement of benefit across the target site, high centre deposition may additionally result in the formation of unsightly residues and unpleasant cooling in that region of the consumer's skin, due to the increased amounts of product deposited there and increased amounts propellant evaporating at that location.

In addition to the above-mentioned shortcomings, a single outlet spray head also places physical limitations on the composition which may be sprayed. In particular, high viscosity compositions may not be practically sprayed, because insufficient energy may be retained in such a fluid under typical pressurisation conditions for it to become sufficiently atomised on leaving the spray outlet.

With reference to U.S. Pat. No. 3,767,125, a multi-outlet spray head is proposed for spraying dry powder aerosols.

With reference to U.S. Pat. No. 5,516,045, an alternative multi-outlet spray head is disclosed, especially for spraying hair lacquer.

It would be advantageous to provide a spray head which overcomes the disadvantages of spray heads disclosed in the prior art.

SUMMARY

According to a first aspect of the invention a spray head for attachment to an aerosol container containing pressurised product is provided, the spray head comprising at least two separate spray outlets, wherein at least one of the spray outlets (3) has a non-circular cross-sectional shape.

According to a second aspect of the invention, an pressurised aerosol spray unit is provided, having a spray head as defined in the first aspect of the invention.

According to a third aspect of the invention, a portable pressurised aerosol spray unit is provided, having a spray head as defined in the first aspect of the invention.

According to a fourth aspect of the invention, a process for spraying a pressurised product is provided, comprising the steps of spraying said product through a spray head according to the first aspect of the invention, such that the product has a Reynolds Number of at least 3000 as it leaves said spray outlets.

These and other features, aspects, and advantages of the present invention will become evident to those skilled in the art from a reading of the present disclosure.

BRIEF DESCRIPTION OF THE DRAWINGS

While the specification concludes with claims which particularly point out and distinctly claim the invention, it is believed the present invention will be better understood from the following description of preferred embodiments taken in conjunction with the accompanying drawings, in which like reference numerals identify identical elements and in which:

DETAILED DESCRIPTION

While the specification concludes with claims which particularly point out and distinctly claim the invention, it is believed the present invention will be better understood from the following description.

All weights, measurements and concentrations herein are measured at 25° C. on the composition in its entirety, unless otherwise specified.

Unless otherwise indicated, all percentages of compositions referred to herein are weight percentages of the total composition (i.e. the sum of all components present) and all ratios are weight ratios.

Unless otherwise indicated, the content of all literature sources referred to within this text are incorporated herein in full by reference.

Except where specific examples of actual measured values are presented, numerical values referred to herein should be considered to be qualified by the word "about".

As has been discussed, a limitation of traditional aerosol spray head configurations is that they may produce an uneven distribution of product on the target site. In addition, the viscosity of the product to be sprayed may be practically constrained to remain below a certain level.

By introducing instability into the fluid flow at an early stage it is possible to atomize products with greater viscosities and, at the same time, improve the product distribution on the target site. The replacement of a single spray outlet by multiple outlets may assist in introducing that instability, because, for a given volume flow of product, the size of the shear interface (i.e. the total outlet perimeter size) is greater for multiple outlets than for a single outlet. The utilisation of one or more non-circular outlets may additionally assist in introducing early instability into the flow. Without wishing to be bound by theory, it is believed that these measures may prevent the formation of a smooth film structure just outside the outlet where the product commences its trajectory to the target site. The disadvantage of a smooth film structure is that it may propagate a relatively coarse atomization in the final stage before the product reaches the target site, with the drops at the center of the spray being larger than those near the periphery. It is in the final stage of the spray formation where an instability in the system may help disintegrate the product into ligaments and then further into drops to form a highly atomised spray and an improved drop distribution.

As defined above, the present invention overcomes the disadvantages of the prior art by providing a spray head (1) comprising at least two separate spray outlets (3), wherein at least one the spray outlets (3) and advantageously all of the spray outlets (3) have a non-circular cross-sectional shape.

As used herein, the term "circle" means a closed plane curve every point of which is equidistant from a fixed point within the curve and the word "circular" shall be interpreted accordingly.

Figure 3:
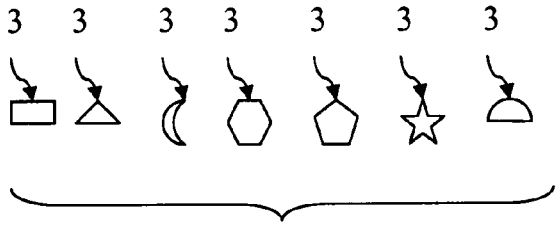
FIG. 3 is an enlarged view of several exemplary spray outlet cross-sectional shapes.

With reference to FIG. 3, the spray outlets (3) may have any non-circular shape, but advantageously have a cross-sectional shape selected from the group consisting of polygonal, semi-circular, crescent, stellate and mixtures thereof. If polygonal, then each polygonal cross-sectional shape may advantageously be selected from the group consisting of polygons having from three to ten sides. Preferably, the polygons are selected from the group consisting of triangular, rectangular, pentagonal, hexagonal and mixtures thereof.

The spray head (1) according to the invention may have any number of spray outlets (3) above two, but preferably has from 2 to 36 and more preferably from 3 to 12 spray outlets (3).

The spray head (1), according to the first aspect of the invention may additionally comprise a splitting chamber (4) for diverting the flow to the spray outlets (3), wherein the conduit means comprise inlet means (5) for attachment to a valve stem (11) of the aerosol spray unit and outlet means which are in fluid communication with the splitting chamber (4), wherein the splitting chamber (4) is in fluid communication with the spray outlets (3).

Figure 1:
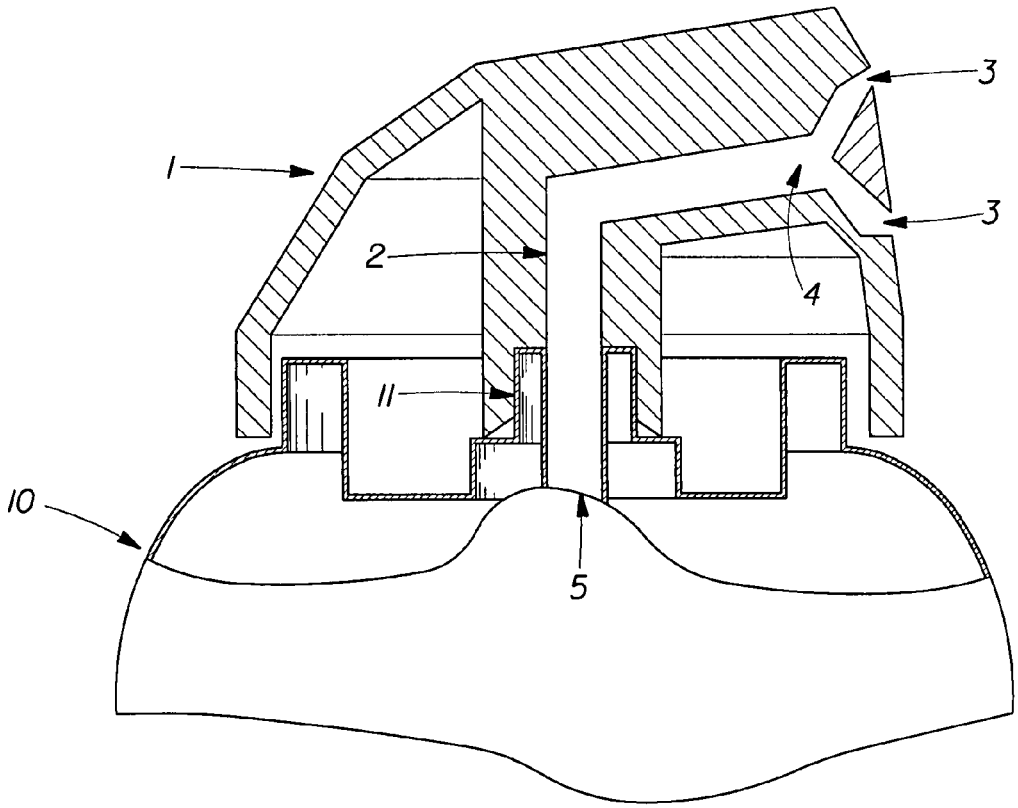
FIG. 1 is a cross-sectional view of a spray head according to the invention
Figure 2:
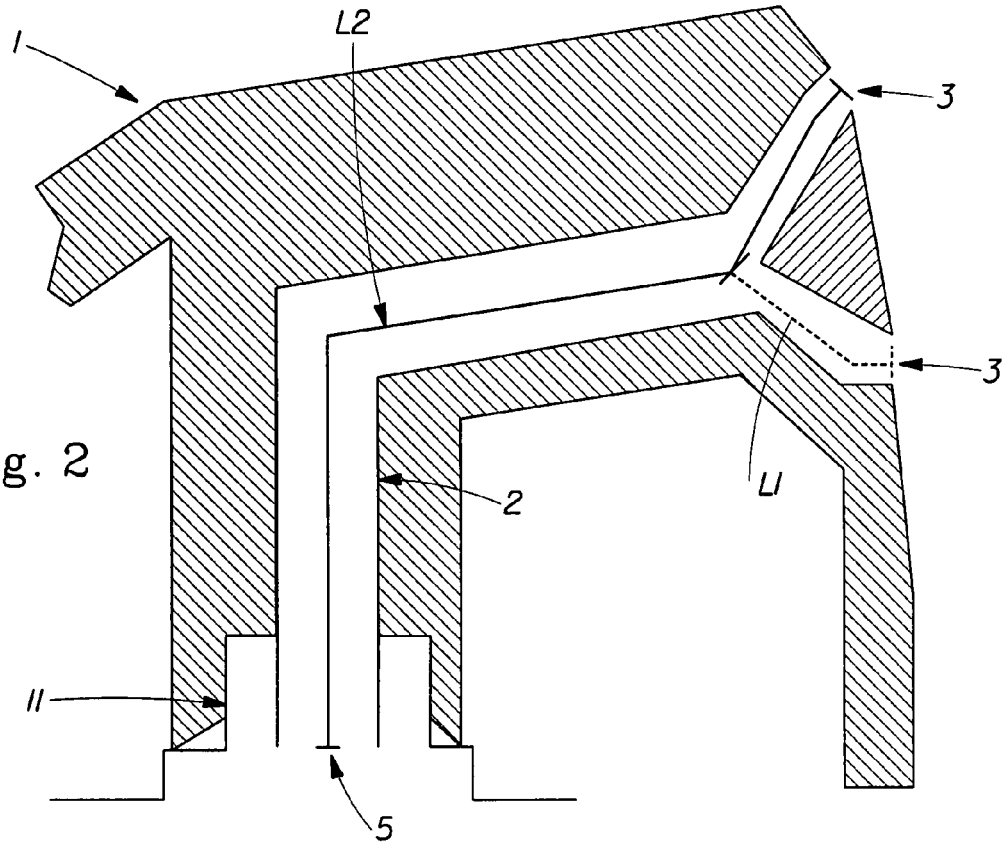
FIG. 2 is an enlarged cross-sectional view of the important parts of a spray head according to the invention.

In this event, and as best shown in FIG. 2, the ratio, L1/L2, for each spray outlet of the distance (L1) between the splitting chamber (4) and the spray outlet (3) to the distance (L2) between the inlet means (6) and the spray outlet (3) is advantageously, in the range 0.01 to 0.6, more advantageously in the range 0.015 to 0.4 and more advantageously still in the range 0.02 to 0.4. This is because it is advantageous to locate the point at which the flow splits to travel to the two or more separate spray outlets close to the spray outlets such that most of the flow in the spray head occurs prior to the split. This measure may ensure that the product sprayed is homogenous and may minimise differences between the product sprayed from different spray outlets.

In the event that the conduit and/or ducts leading to the spray outlets have a non-constant cross-sectional area such that either or both of L1 and L2 may vary depending on the line of measurement, then the measurements must be made along the centre line connecting the centres of the inlet means (5), the conduit outlet means and the respective spray outlet (3).

According to a second aspect of the invention, an aerosol spray unit (10) is provided comprising a pressurised product to be dispensed and having a spray head (1) according to the first aspect of the invention.

As used herein, the term "spray unit" means a pressurised aerosol canister, comprising a valve, the valve stem of which extends from the canister, typically at the top. Such canisters typically have a volume up to 1000 ml, though more typically at or below 200 ml and are typically pressurised at 103 kPa to 552 kPa (15 to 80 psi), more typically at or less than 414 kPa (60 psi).

As used herein, the term "product" means all components of the composition or mixture contained within the spray unit, including all active agents, all carrier materials and all propellant.

Preferably, the product to be dispensed is a cosmetic product, more preferably it is selected from the group consisting of antiperspirants, deodorants and mixtures thereof.

If the product to be dispensed is an antiperspirant, then it may comprise antiperspirant active particulates and a carrier such that the antiperspirant active particulates are not soluble in the carrier. Alternatively, the antiperspirant active may be solubilised in the carrier.

According to a third aspect of the invention, a portable aerosol spray unit (10) is provided comprising a pressurised product to be dispensed and a spray head (1) according to the first aspect of the invention.

As used herein, the term "portable" used in relation to an aerosol spray unit means that it may readily be transported in one hand by a single adult person of ordinary strength.

According to a fourth aspect of the invention, a process for spraying a pressurised product is provided comprising the steps of spraying said product through a spray head having at least two separate spray outlets (3), wherein at least one of the spray outlets (3) has a non-circular cross-section, such that the product has a Reynolds Number of at least 3000 as it leaves said spray outlets (3).

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aerosol spray unit comprising a pressurised liquid product to be dispensed and having a spray head comprising at least two separate spray outlets wherein at least one of the spray outlets has a non-circular cross-sectional shape, and a conduit means and a splitting chamber for diverting the flow to the spray outlets, wherein the conduit means comprises inlet means for attachment to a valve stem of the aerosol spray unit and outlet means which are in fluid communication with the splitting chamber, wherein the splitting chamber is in fluid communication with the spray outlets, and wherein for each spray outlet, the ratio L1/L2 of the distance (L1) between the point at which the flow splits to travel to the separate spray outlets and the spray outlet to the distance (L2) between the inlet means and the spray outlet is from 0.015 to 0.4.

2. The aerosol spray unit of claim 1 wherein the product to be dispensed is a cosmetic product.

3. The aerosol spray unit of claim 2, wherein the product to be dispensed is selected from the group consisting of antiperspirants, deodorants and mixtures thereof.

4. The aerosol spray unit of claim 3 wherein the product to be dispensed is an antiperspirant composition comprising antiperspirant active particulates and a carrier, wherein the antiperspirant active particulates are not soluble in the carrier.

5. The aerosol spray unit of claim 3 wherein the product to be dispensed is an antiperspirant composition comprising antiperspirant active and a carrier, wherein the antiperspirant active is solubilised in the carrier.

6. The aerosol spray unit of claim 1 wherein the aerosol spray unit is portable.

7. The aerosol spray unit of claim 1 wherein at least one of the spray outlets has a semi-circular cross-sectional shape.

8. The aerosol spray unit of claim 1 wherein all the spray outlets has a semi-circular cross-sectional shape.

* * * * *